US008693721B2

(12) United States Patent
Chen

(10) Patent No.: US 8,693,721 B2
(45) Date of Patent: Apr. 8, 2014

(54) EARPHONE INTEGRATED WITH A MICROPHONE

(76) Inventor: Lu-Cheng Chen, Taipei (TW)

( * ) Notice: Subject to any disclaimer, the term of this patent is extended or adjusted under 35 U.S.C. 154(b) by 34 days.

(21) Appl. No.: 13/355,501

(22) Filed: Jan. 21, 2012

(65) Prior Publication Data

US 2013/0028462 A1 Jan. 31, 2013

(30) Foreign Application Priority Data

Jul. 25, 2011 (TW) ..... 100126219 A

(51) Int. Cl.
*H04R 25/00* (2006.01)

(52) U.S. Cl.
USPC ..... 381/375; 381/370; 381/380

(58) Field of Classification Search
USPC ..... 381/355, 361, 370–371, 374–375, 380, 381/384
See application file for complete search history.

(56) References Cited

U.S. PATENT DOCUMENTS 7,362,876 B2 * 4/2008 Tsai ..... 381/380

* cited by examiner

*Primary Examiner* — Suhan Ni
(74) *Attorney, Agent, or Firm* — Li & Cai Intellectual Property (USA) Office

(57) ABSTRACT

An earphone integrated with a microphone includes a housing, a speaker, a microphone (audio-recording device), and a supporting member. The housing has an audio-output hole formed thereon a receiving space formed therein. The speaker and the microphone are arranged in the receiving space. The supporting member is arranged in the housing. One end of the microphone is mounted on the supporting member for suspending the microphone in the receiving space. A buffering space is formed around the microphone. Thus, the earphone can achieve anti-noise effect in providing improved communication quality.

12 Claims, 14 Drawing Sheets

EARPHONE INTEGRATED WITH A MICROPHONE

BACKGROUND OF THE INVENTION

1. Field of the Invention

The instant disclosure relates to an earphone integrated with a microphone; in particular, to an earphone structure wherein a microphone and an earphone is integrally formed as a single unit.

2. Description of Related Art

Due to the rapid development of the 3C communication and the convenience of electrical communication products, earphones are being used in widespread fashion nowadays. For example, earphones and microphones are common communication tools for listening to music, using mobile phones, or surfing the internet. To provide convenience, conventional earphones already have designs integrated with microphones to receive and produce sound on a single device.

However, for conventional earphones with integrated microphones, both the speaker and the microphone are arranged in a same housing. Vibrations due to acoustic waves from the speaker would propagate to and interfere with the microphone. The listener on the receiving end may be exposed to background noise, which adversely affects the communication quality.

SUMMARY OF THE INVENTION

The object of the instant disclosure is to provide an earphone integrated with a microphone having anti-noise capability to enhance communication quality.

Another object of the instant disclosure is to provide an earphone integrated with a microphone having echo-cancelling ability to enhance communication quality.

An embodiment of the instant disclosure provides an earphone integrated with a microphone, comprising: a housing which has an audio-output hole arranged thereon and a receiving space defined therein; a speaker accommodated in the receiving space of the housing; an audio recording-type microphone accommodated in the receiving space of the housing; and a supporting member arranged in the housing. One end of the microphone is mounted on the supporting member in a suspended manner in the receiving space, where a clearance or spacing is provided between the microphone and the inner wall of the housing.

An embodiment of the instant disclosure provides another earphone integrated with a microphone, comprising: a housing including a front portion and a back portion, where a first channel is formed therebetween in defining a spacing, and the housing has an audio-output hole arranged thereon; a speaker arranged inside the back portion of the housing; and an audio recording-type microphone arranged inside the front portion of the housing.

The instant disclosure provides the following advantages:

The microphone is suspended inside the housing by the supporting member. Thus, the majority of the microphone is spaced from the internal walls of the housing in forming the spacing therebetween. Thereby, enhanced anti-vibration and buffering effect can be provided to the microphone. Namely, vibrations induced by the acoustic waves from the speaker will not reach the microphone via the housing. Hence, the anti-noise effect can be achieved by the earphone to improve communication quality.

Additionally, the front and the back portions of the housing can further be separated by the first channel to form the spacing therebetween. The speaker and the microphone are arranged inside the back and the front portions of the housing, respectively, in keep an appropriate distance therebetween. Thereby, vibrations induced by the acoustic waves from the speaker are not easily transferred to the microphone via the housing. Hence, the anti-noise effect can be achieved by the earphone to improve communication quality.

The front portion of the housing, moreover, can further be divided into a first shell and a second shell. A second channel is formed between the first and second shells in defining a spacing therebetween. For the speaker and the microphone, the corresponding acoustic paths can be isolated without interfering one another. The anti-noise and echo-cancelling effects can be achieved by the earphone to improve the communication quality.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

Figure 1:
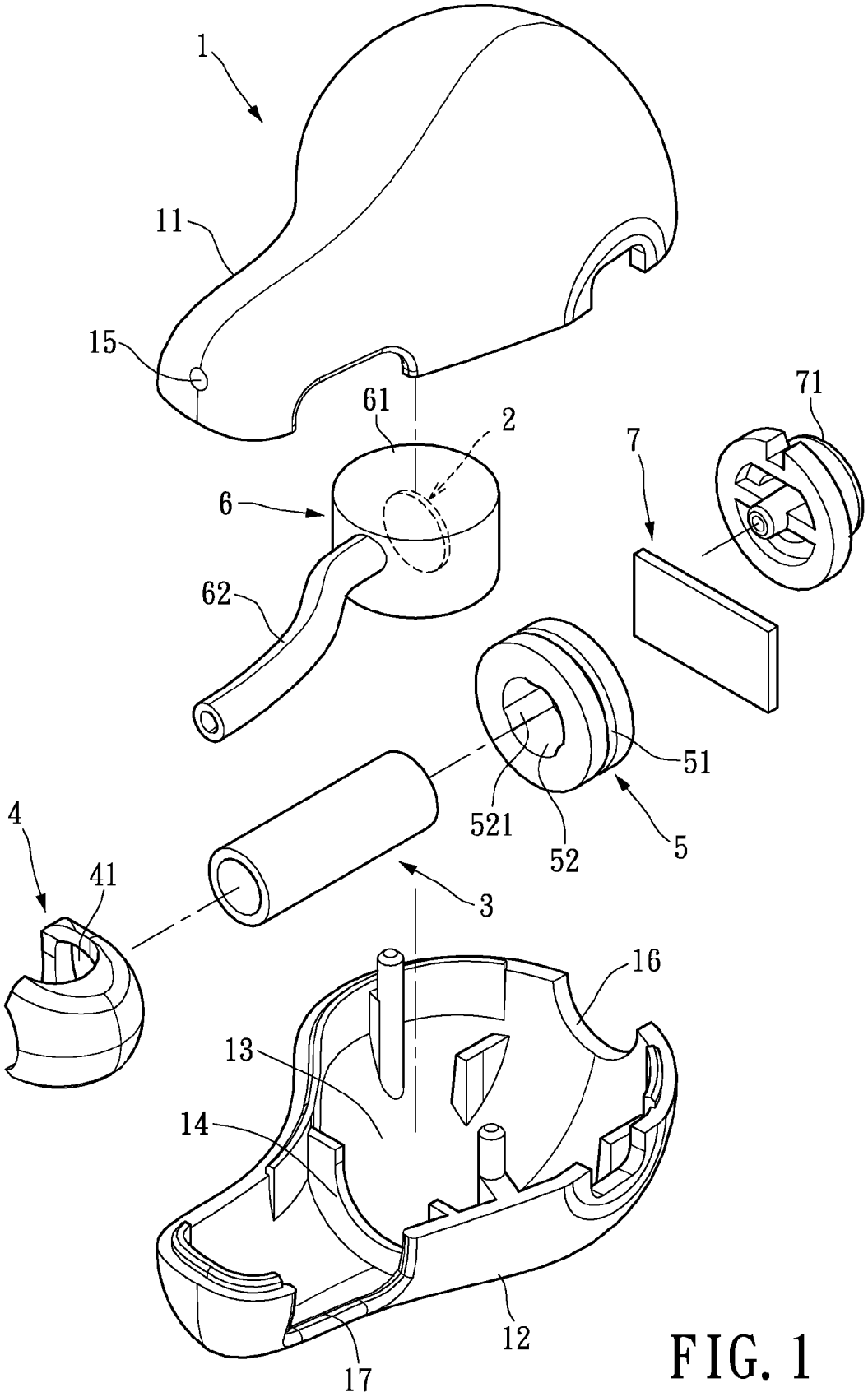
FIG. 1 shows an exploded view of the earphone according to the first embodiment of the instant disclosure.
Figure 2:
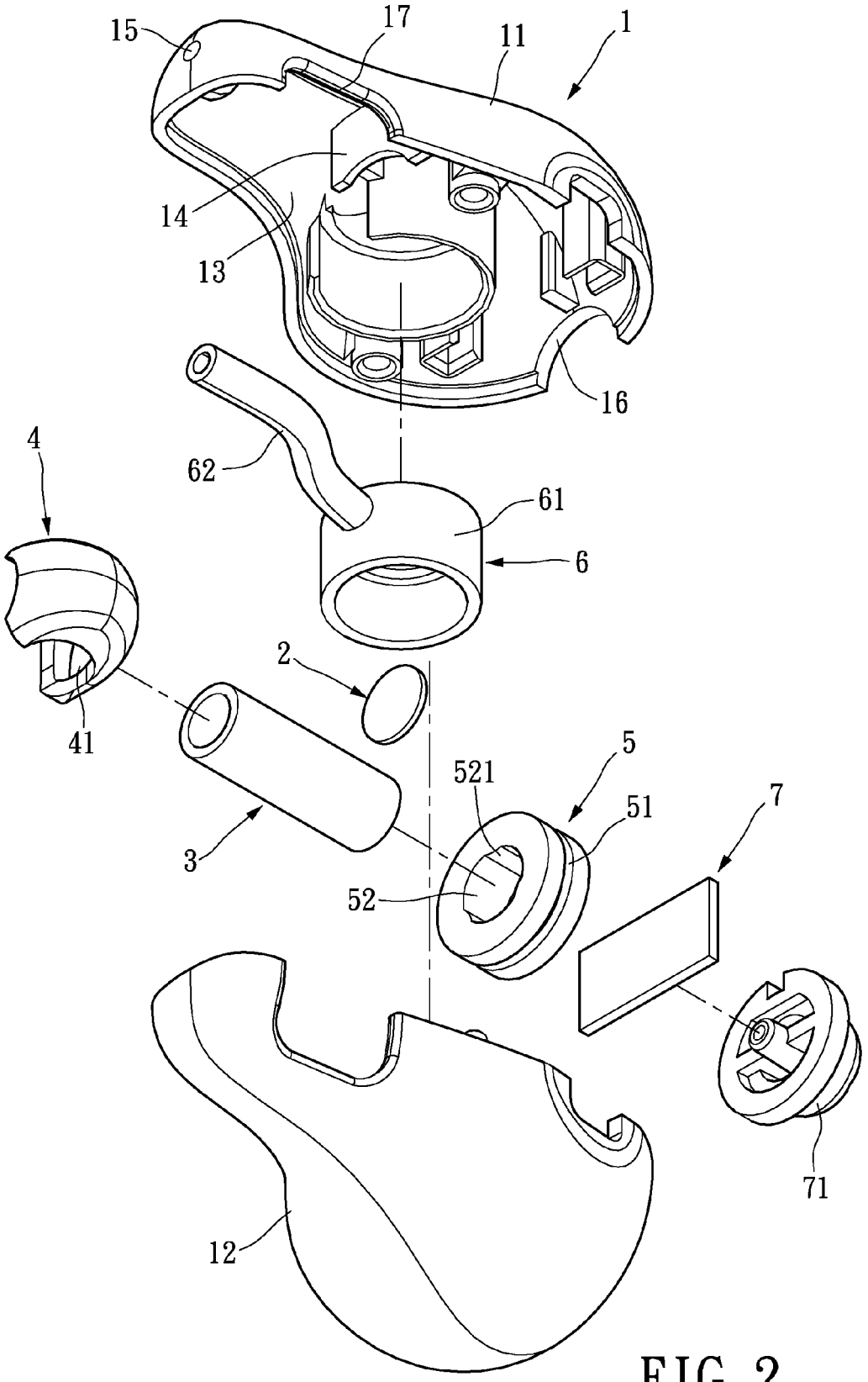
FIG. 2 shows another exploded view (2) of the earphone according to the first embodiment of the instant disclosure.
Figure 3:
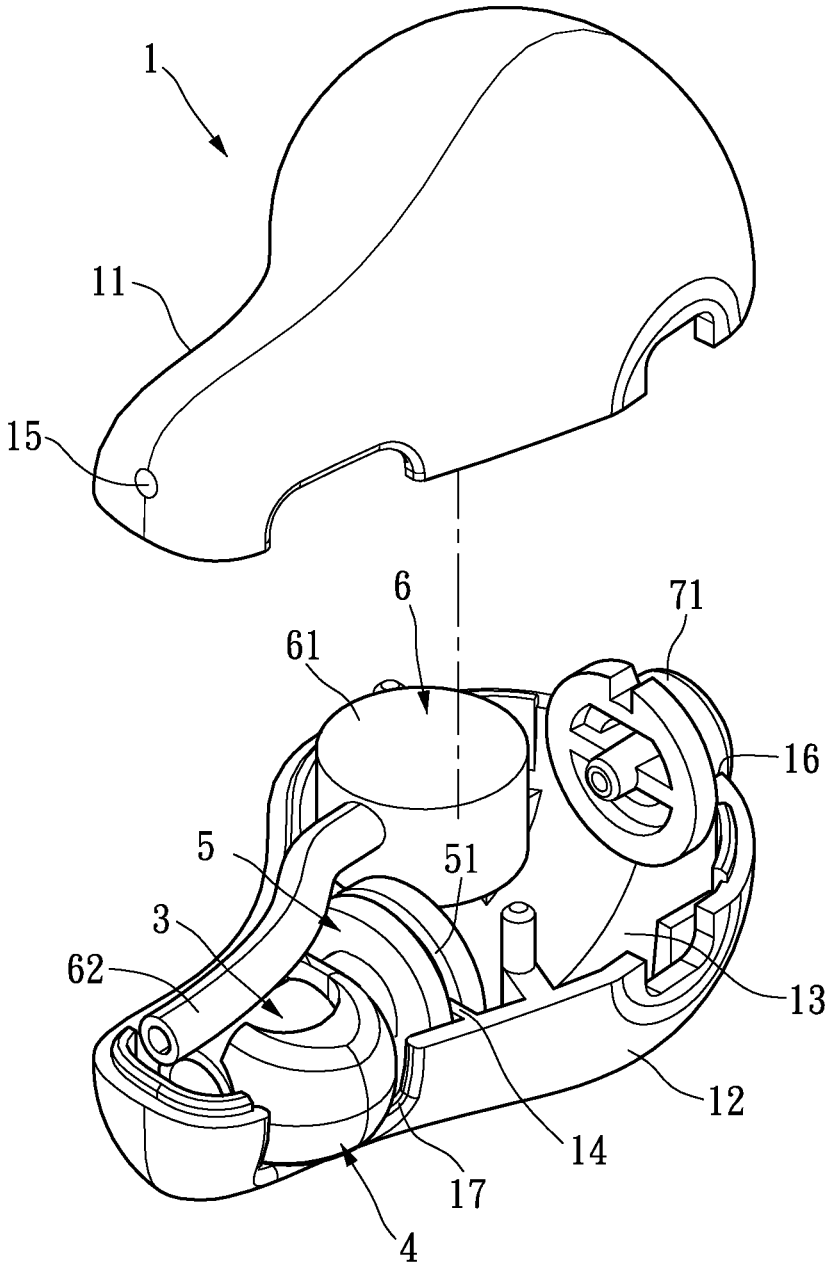
FIG. 3 shows an assembled view of the earphone according to the first embodiment of the instant disclosure.
Figure 4:
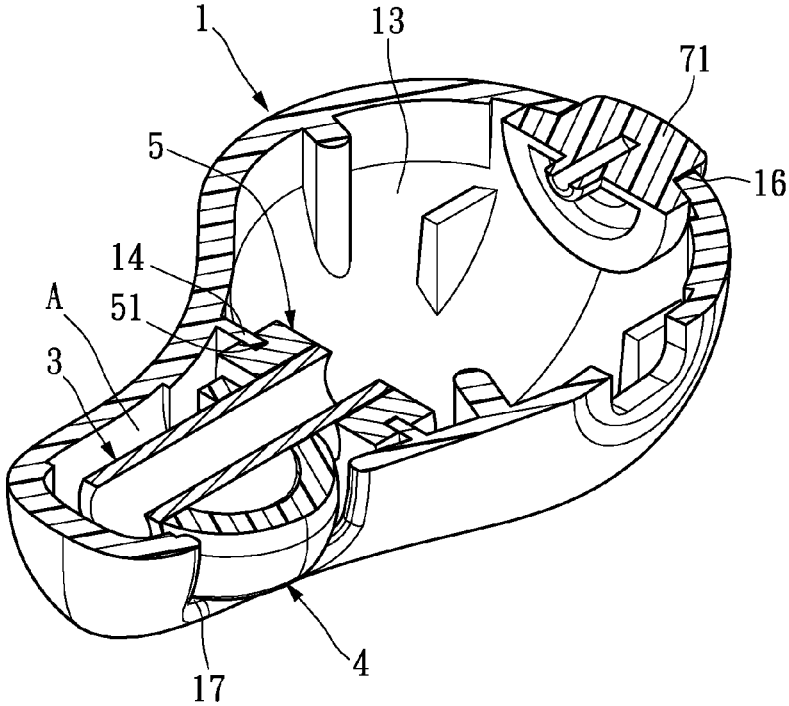
FIG. 4 shows a cross-sectional view (1) of the earphone according to the first embodiment of the instant disclosure.
Figure 5:
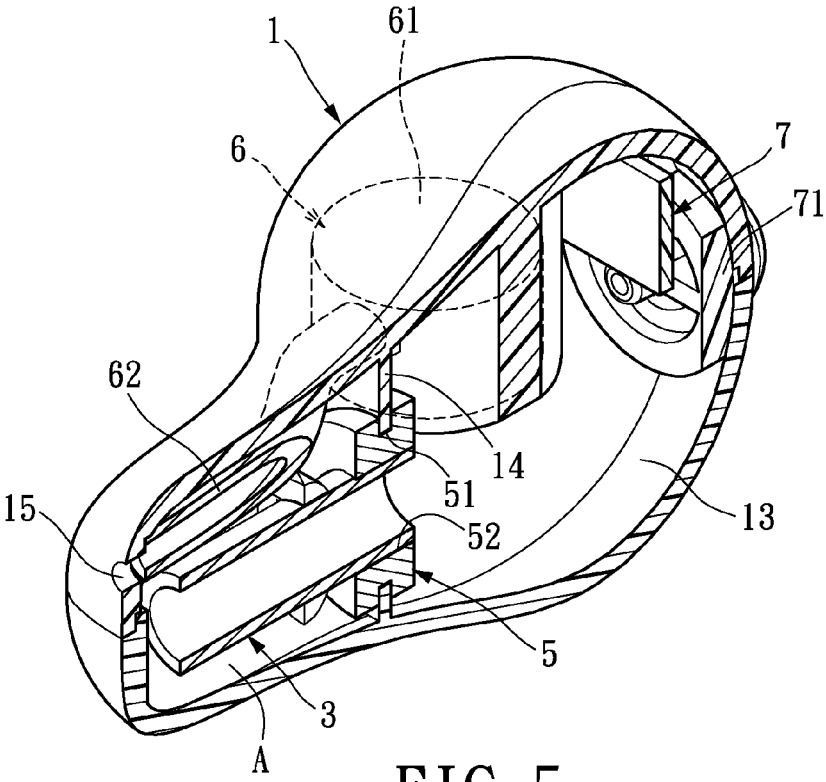
FIG. 5 shows another cross-sectional view (2) of the earphone according to the first embodiment of the instant disclosure.
Figure 6:
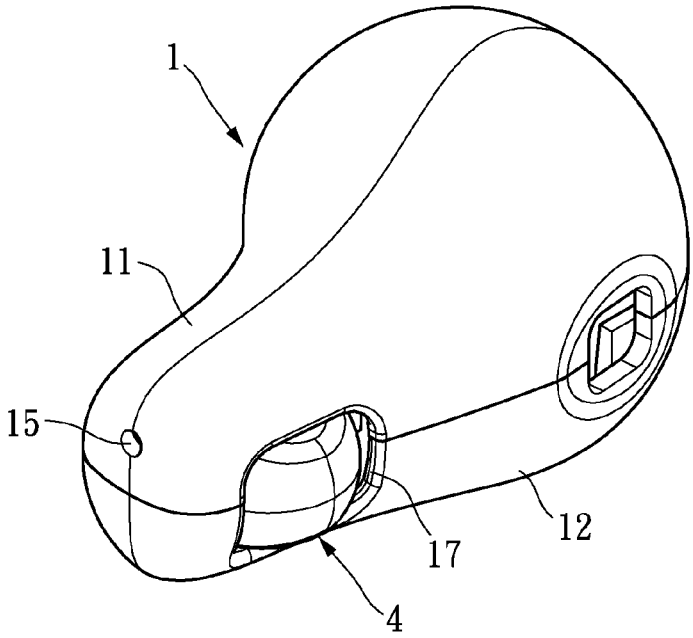
FIG. 6 shows a perspective view of the earphone according to the first embodiment of the instant disclosure.

The aforementioned illustrations and following detailed descriptions are exemplary for the purpose of further explaining the scope of the instant disclosure. Other objectives and advantages related to the instant disclosure will be illustrated in the subsequent descriptions and appended drawings.

The First Embodiment

With reference to FIGS. 1-6, the instant disclosure provides an earphone structure integrated with a microphone. The earphone comprises a housing 1, a speaker 2, a microphone 3, an ear-abutting member 4, and a supporting member 5. The housing 1 is made from materials such as plastic, but is not restricted thereto. The housing 1 of the instant embodiment is made from acrylonitrile butadiene styrene (ABS) hard plastic. The housing 1 may include a first semi-housing 11 and a second semi-housing 12. The first and the second semi-housings 11, 12 may be interconnected by screws, snap-in means, gluing, etc. The structure of the housing 1 is not restricted, where the housing 1 may be a one-piece, two-piece, or multi-piece structure.

A receiving space 13 and a fastening portion 14 are formed in the housing 1. The speaker 2, the microphone 3, the ear-abutting member 4, and the supporting member 5 are accommodated by the receiving space 13. The fastening portion 14 is a protruding structure from the inner wall of the housing 1, where the physical nature of the fastening portion 14 is not restricted. The fastening portion 14 of the instant embodiment is a plate body annularly arranged on the inner wall of the housing 1 near the central portion thereof. An audio-output hole 15 is formed on one end of the housing 1, and a receiving hole 16 for holding a button is formed on another end thereof The audio output hole 15 is preferably arranged on one end (front end) of the housing 1 for insertion into the user's ear canal. To put in use, the earphone of the instant embodiment is inserted into the user's ear canal.

The speaker 2 is arranged in the receiving space 13 of the housing 1 away from the audio output hole 15. However, the location of the speaker 2 is not restricted. In addition, a speaker box 6 is further arranged in the receiving space 13 for guiding the sound from the speaker 2 to the voice output hole 15. The speaker box 6 is made from material such as silicone, but is not restricted thereto. The speaker box 6 has a main body 61 and a sound guide 62. The main body 61 is substantially a cup-shaped hollow structure arranged toward the receiving hole 16. One end of the sound guide 62 is connected to the main body 61, and another end of the sound guide 62 is extended to the audio output hole 15. The speaker 2 is arranged inside the main body 61. The sound produced by the speaker 2 is collected by the main body 61 and is guided to the audio output hole 15 through the sound guide 62.

The microphone 3 is an audio recording device arranged in the receiving space 13 of the housing 1. The material composition and structural configuration of the microphone 3 are not restricted. For the instant embodiment, the microphone 3 is an audio recording microphone that picks up sound vibrations carried through air. The microphone 3 is made with copper and may be round, square or flattened pipe shaped, where the shape thereof is not restricted. The microphone 3 is arranged in the receiving space 13 toward the audio-output hole 15, and the speaker box 6 is arranged above the microphone 3 in the present orientation shown in the figures. Hence, the microphone 3, the speaker box 6, and the speaker 2 can each be isolated from interfering with each other. The speaker 2 and the microphone 3 are wired (not shown) electrically to a circuit unit 7, and a button 71 is installed in the receiving hole 16 of the housing 1. The button 71 is connected electrically to the circuit unit 7 and may be pressed to operate the earphone. Nevertheless, the circuit unit 7 and the button 71 can be neglected or replaced by other means.

The earphone of the instant disclosure may be wired or entirely wireless, or be used as a Bluetooth in-ear version headphone. For the wired earphone, a suitable signal wire (not shown) can be connected to the circuit unit 7. For a wireless earphone or a Bluetooth earphone, a wireless transceiving circuit can be arranged in the circuit unit 7.

The ear-abutting member 4 is made from plastic material, but is not restricted thereto. The ear-abutting member 4 of the instant embodiment is made from ABS hard plastic having a substantially curved body. The ear-abutting member 4 is in contact with the microphone 3 and extends to the outside of the housing 1 through an opening 17 formed on the housing 1. Thereby, the ear-abutting member 4 is able to abut against the user's ear canal. However, the structure of the ear-abutting member 4 is not restricted. In the instant embodiment, a through hole 41 is arranged on the ear-abutting member 4, where the through hole 41 has the same shape as the microphone 3. The microphone 3 is inserted into the through hole 41 of the ear-abutting member 4 to be mutually interconnected. Nevertheless, the ear-abutting member 4 can also be neglected.

The supporting member 5 is made with soft materials such as silicone, but is not restricted thereto. The supporting member 5 is arranged between the housing 1 and the microphone 3, such that the microphone 3 is suspended in the receiving space 13 of the housing 1. In other words, a buffering space A is created between the portion of the microphone 3 away from the supporting member 5 and the housing 1. The supporting member 5 is not restricted structurally. In the instant embodiment, the supporting member 5 is substantially annular-shaped having a restricting slot 51 formed thereon peripherally. The restricting slot 51 is engaged by the fastening portion 14 of the housing 1, such that the supporting member 5 is fixedly secured inside the housing 1. Alternatively, the supporting member 5 may be screwed, glued, or be fixed by using other means inside the housing 1.

The supporting member 5 has a connecting hole 52 formed thereon. One end of the microphone 3 is inserted into the connecting hole 52, such that the microphone 3 is suspended in the receiving space 13. Thereby, the microphone 3 is better buffered against vibration. The connecting hole 52 is defined by an inner surface of the supporting member 5, where a plurality of protrusions 521 may be further formed on the inner surface. The number of the protrusions 521 is ideally but not limited to three. The protrusions 521 abut to the microphone 3 in providing additional buffering against vibrations.

The earphone of the instant disclosure can be inserted into the user's ear canal to receive electronic signals from walkmans, computers, mobile/land phones, or other electronic products. The electronic signals are then converted into sound-wave signals before transmitting into the speaker 2 to produce sound. The sound waves are then guided by the speaker box 6 to the audio-output hole 15 in reaching the user's ear. The ear-abutting member 4 can be snugged inside the user's ear canal. Thereby, the ear-abutting member 4 and the microphone 3 can pick up vibrations when a sound is produced, before converting to an electrical signal and transmitting to the circuit unit 7. The use of the vibration-sensitive microphone 3 as an audio receiving device can reduce the effect of background noise.

The Second Embodiment

Figure 7:
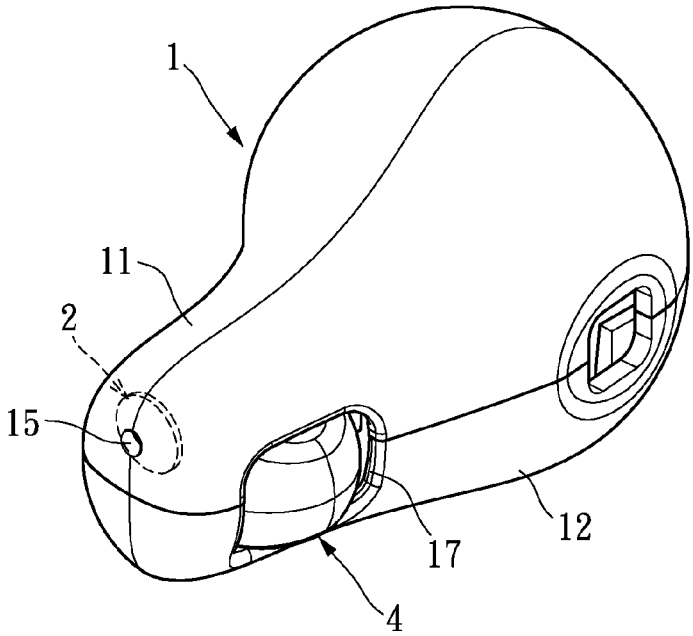
FIG. 7 shows a perspective view of the earphone according to the second embodiment of the instant disclosure.

Referring now to FIG. 7. For the instant embodiment, the speaker 2 is arranged in the receiving space 13 of the housing 1 proximate to the audio-output hole 15. The aforementioned speaker box 6 can be neglected, and the sound produced by the speaker 2 can be transmitted directly to the audio-output hole 15.

The Third Embodiment

Figure 8:
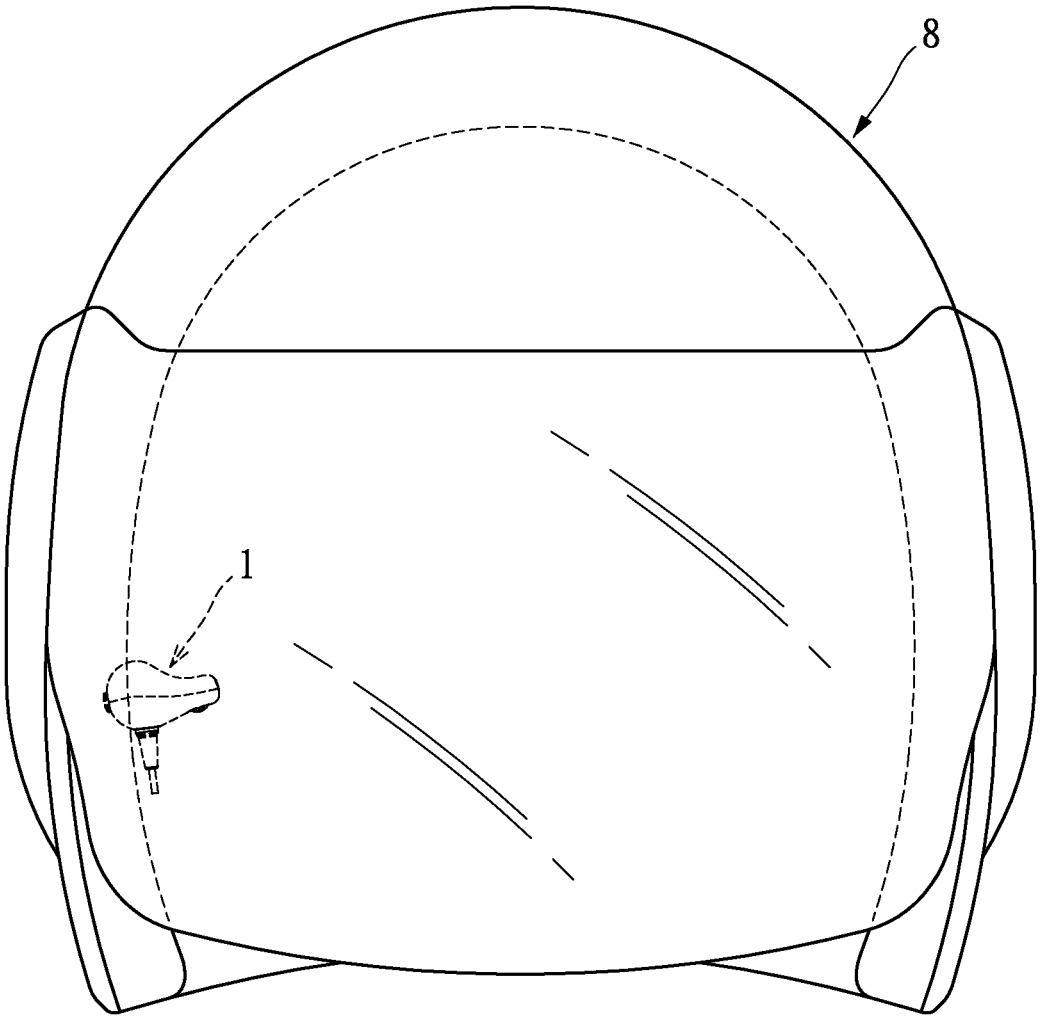
FIG. 8 shows a perspective view of the earphone according to the third embodiment of the instant disclosure.
Figure 9:
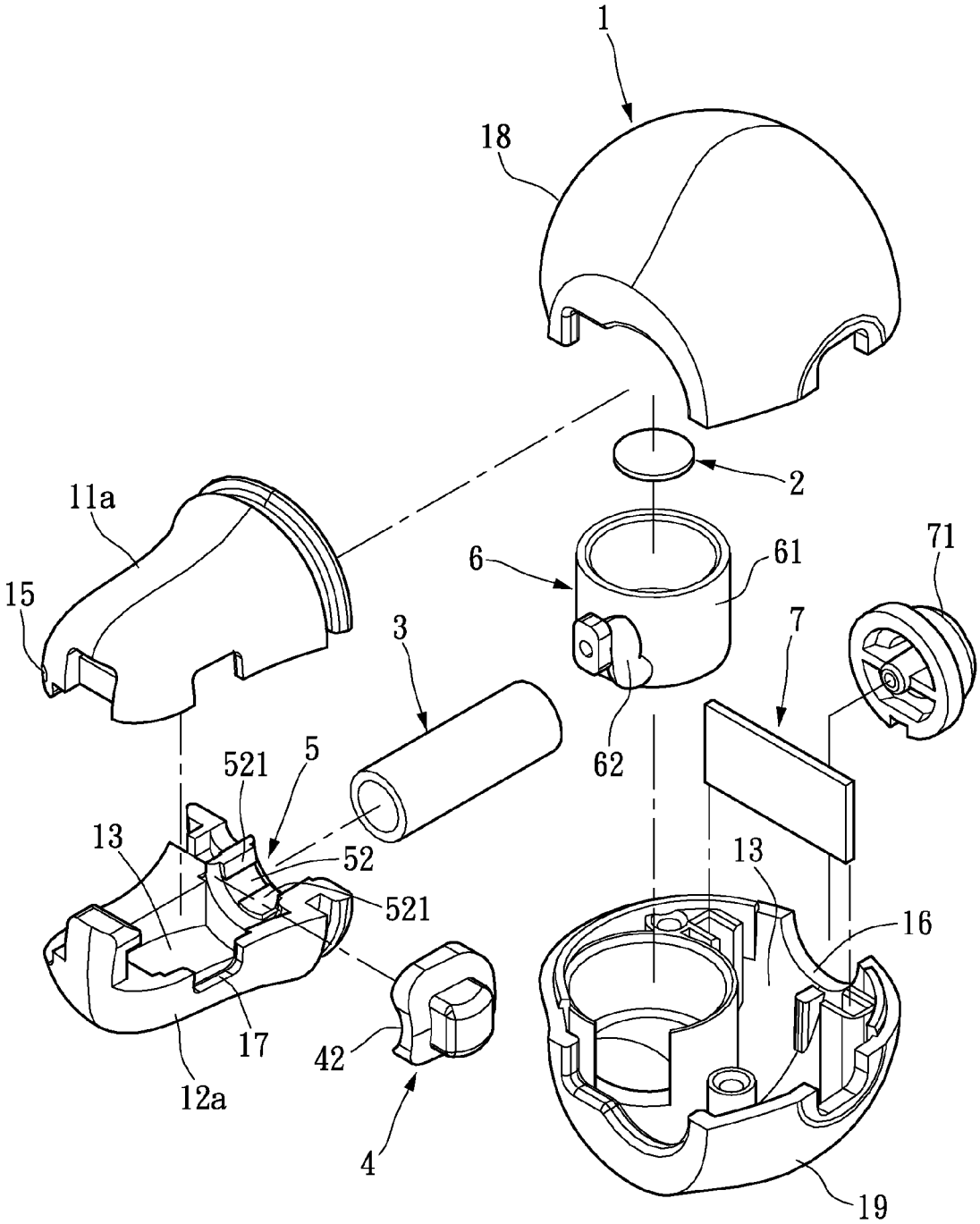
FIG. 9 shows an exploded view (1) of the earphone according to the fourth embodiment of the instant disclosure.
Figure 10:
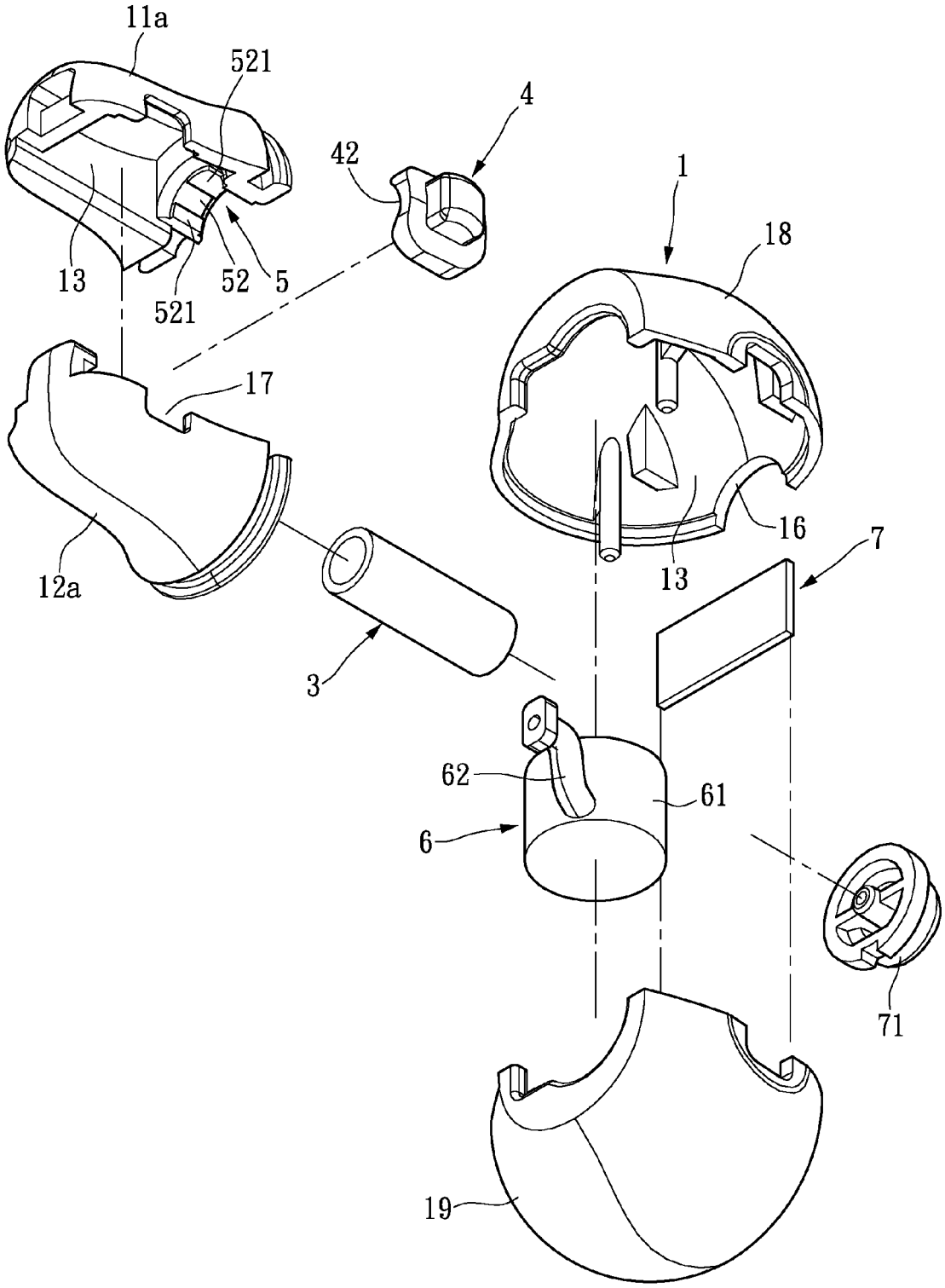
FIG. 10 shows another exploded view (2) of the earphone according to the fourth embodiment of the instant disclosure.
Figure 11:
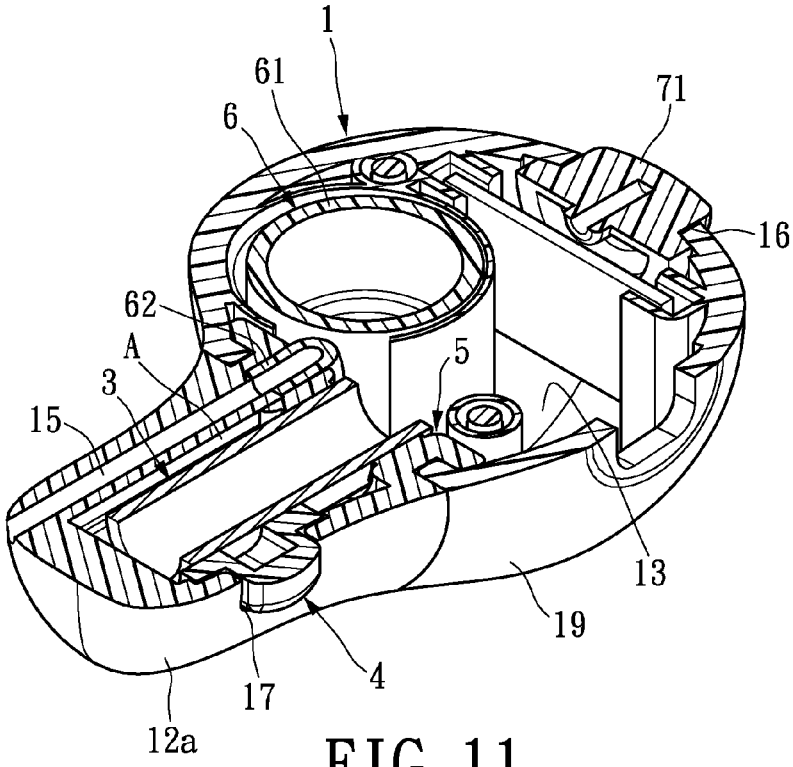
FIG. 11 shows a cross-sectional view (1) of the earphone according to the fourth embodiment of the instant disclosure.
Figure 12:
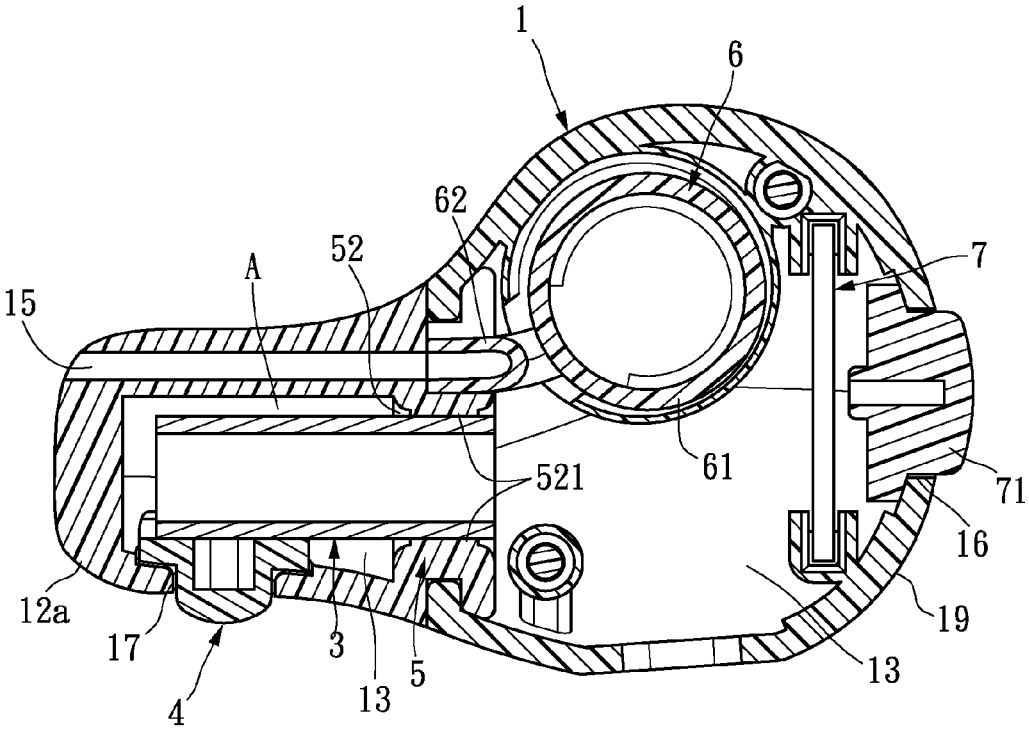
FIG. 12 shows another cross-sectional view (2) of the earphone according to the fourth embodiment of the instant disclosure.
Figure 13:
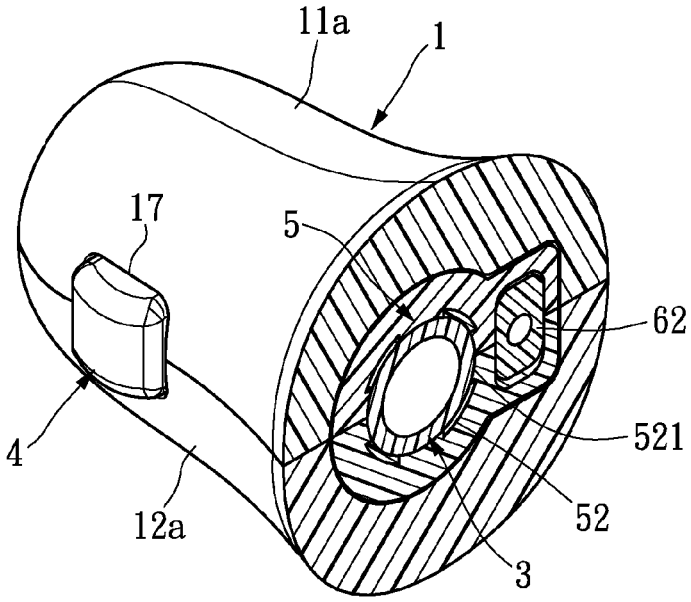
FIG. 13 shows yet another cross-sectional view (3) of the earphone according to the fourth embodiment of the instant disclosure.
Figure 14:
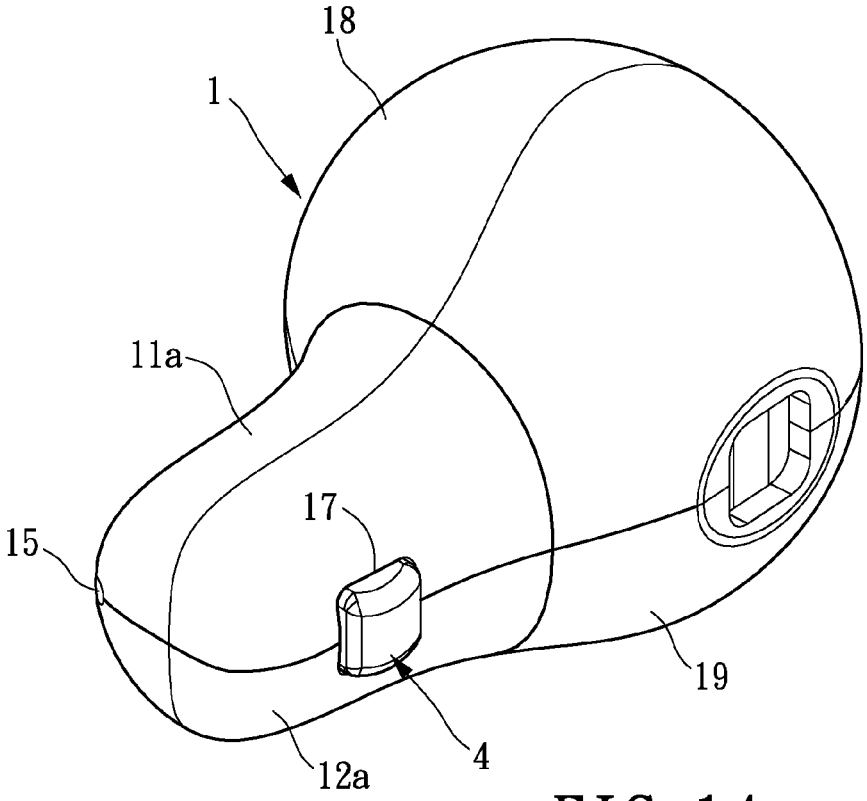
FIG. 14 shows a perspective view of the earphone according to the fourth embodiment of the instant disclosure.
Figure 15:
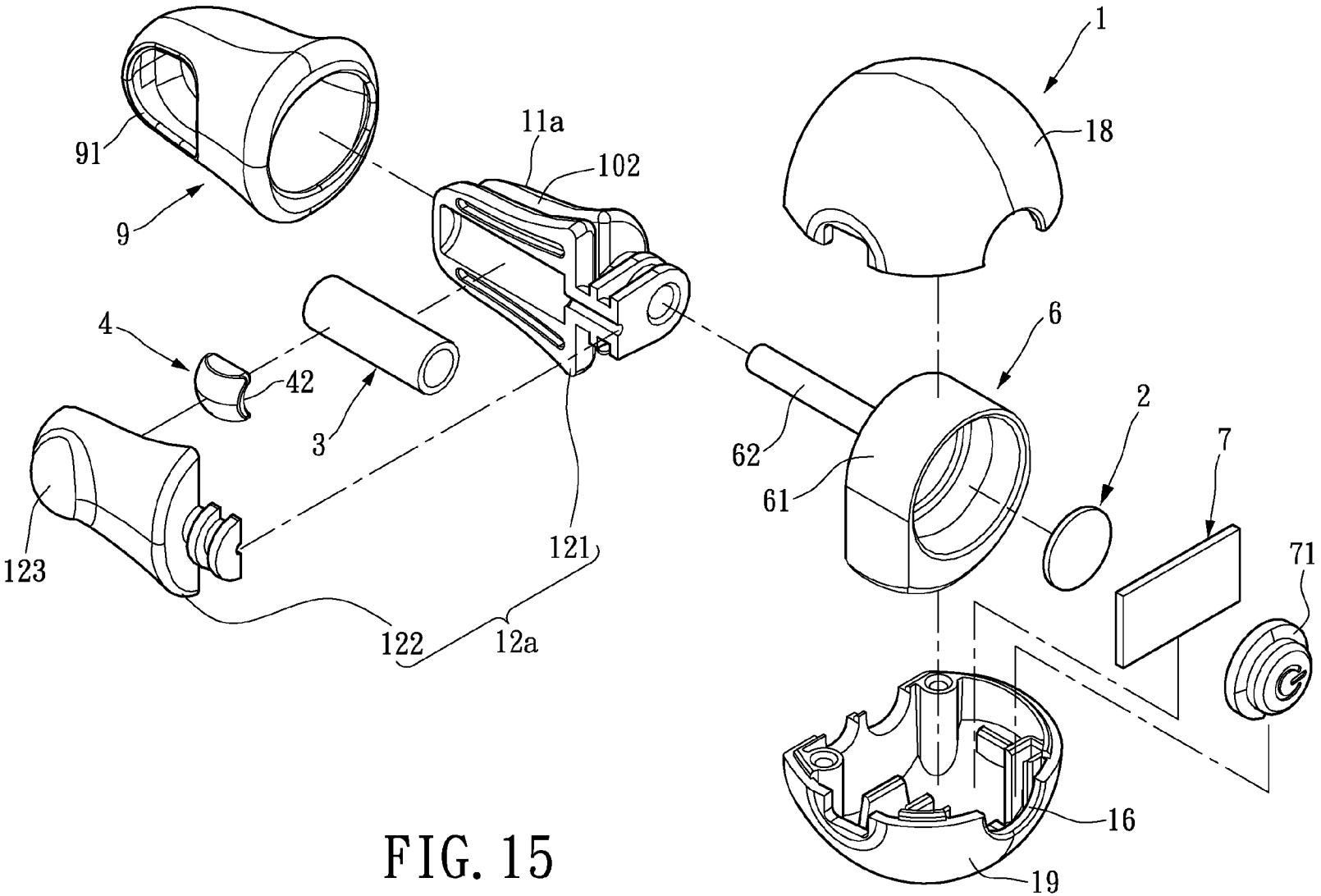
FIG. 15 shows an exploded view (1) of the earphone according to the fifth embodiment of the instant disclosure.
Figure 16:
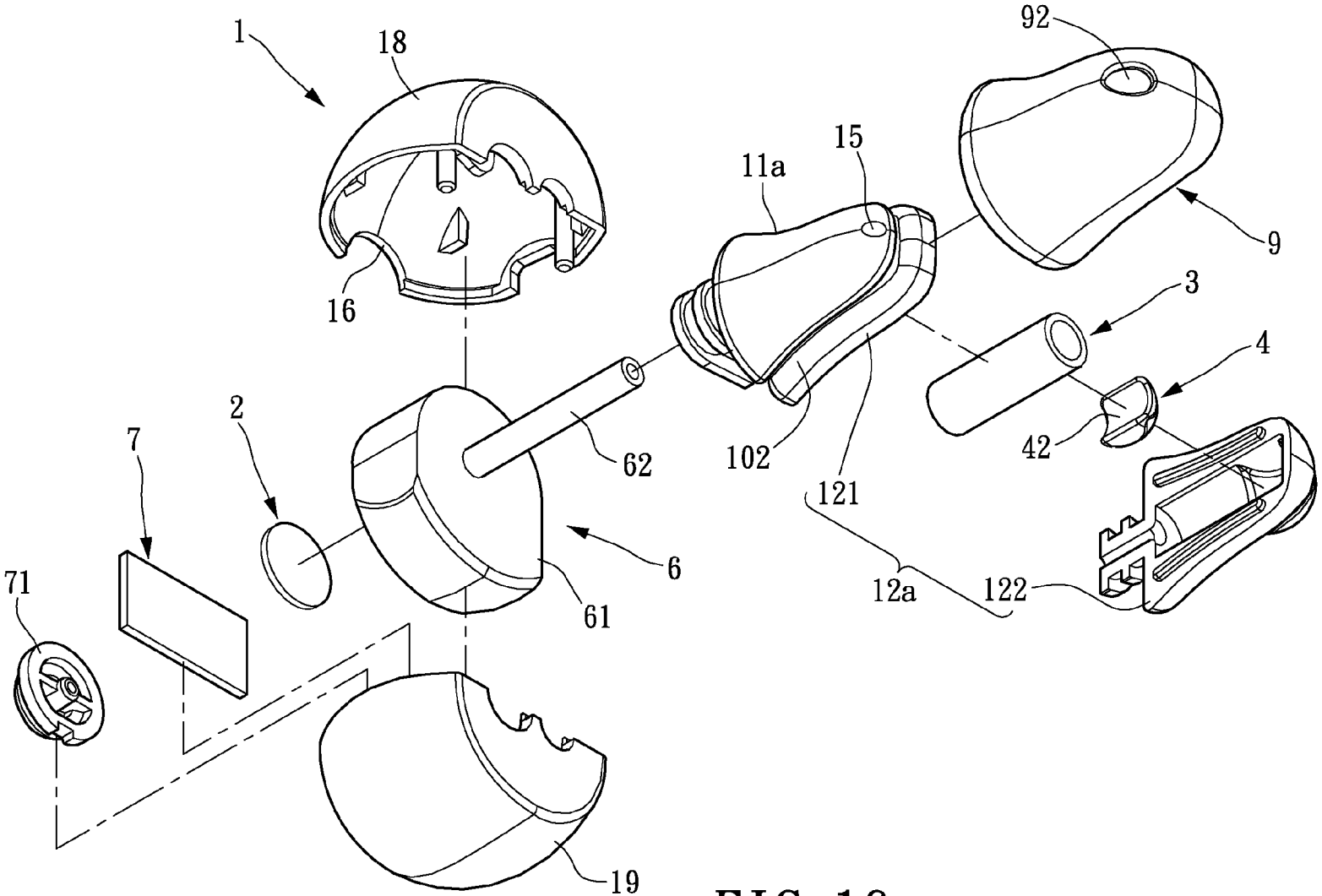
FIG. 16 shows another exploded view (2) of the earphone according to the fifth embodiment of the instant disclosure.
Figure 17:
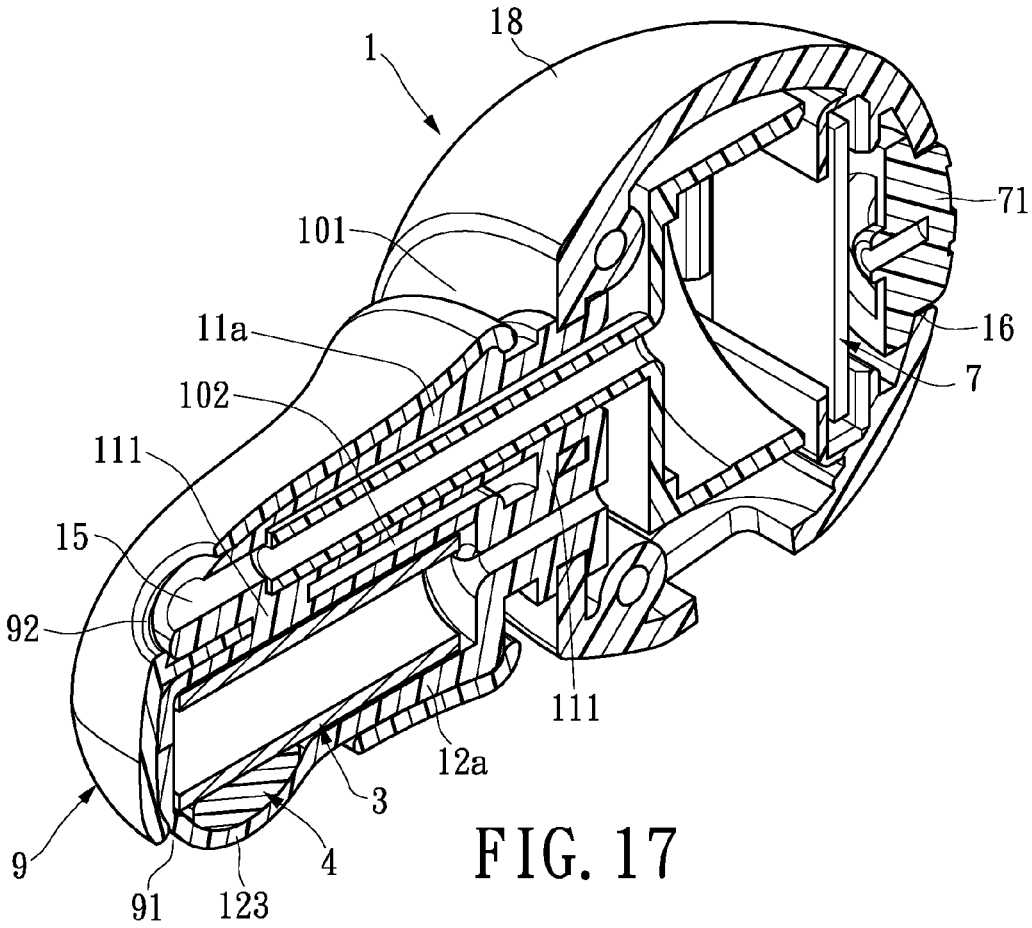
FIG. 17 shows a cross-sectional view (1) of the earphone according to the fifth embodiment of the instant disclosure.
Figure 18:
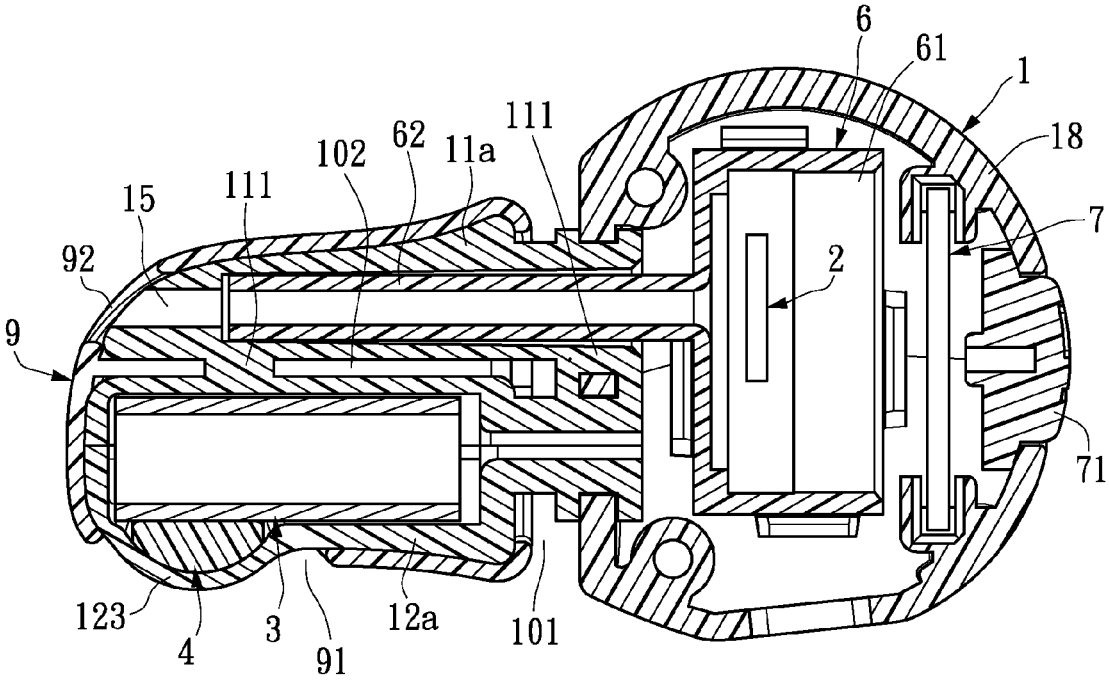
FIG. 18 shows another cross-sectional view (2) of the earphone according to the fifth embodiment of the instant disclosure.
Figure 19:
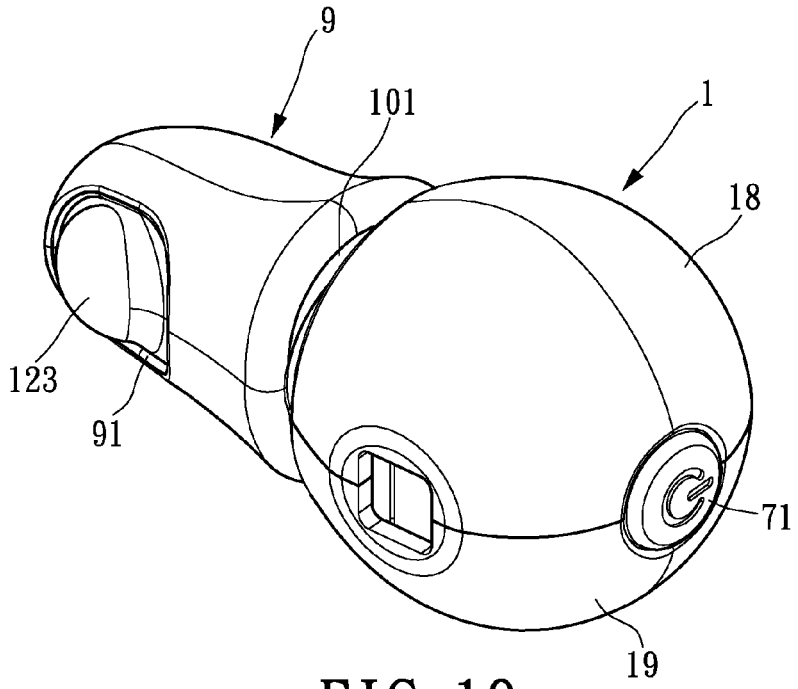
FIG. 19 shows a perspective view of the earphone according to the fifth embodiment of the instant disclosure.
Figure 20:
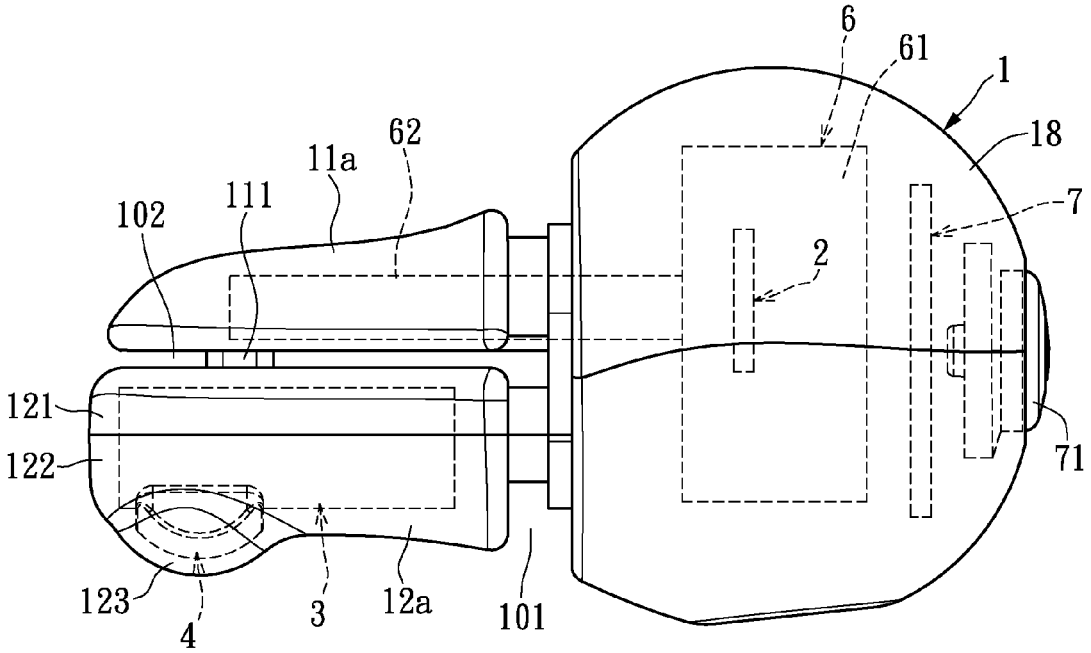
FIG. 20 shows a plane view of the earphone according to the fifth embodiment of the instant disclosure.

With reference to FIG. 8, the instant embodiment discloses that the earphone of the instant disclosure can be arranged on a helmet 8. The helmet 8 may be a helmet used during different sport activities or a safety helmet used when riding an auto-bicycles or a bicycle.

The Fourth Embodiment

With reference to FIGS. 9-14, in the instant embodiment, the housing 1 includes a first front shell 11*a*, a second front shell 12*a*, a first back shell 18, and a second back shell 19. The first and the second front shells 11*a*, 12*a* can be interconnected by screws, snap-in means, or gluing to construct the front portion of the housing 1. Likewise, the first and the second back shells 18, 19 can also be interconnected by the same manner to construct the back portion of the housing 1. The assembly of the first and the second front shells 11*a*, 12*a* and the assembly of the first and the second back shells 18, 19 can be interconnected again by means of using screws, snap-in connections, gluing, etc. For the instant embodiment, the assembling of the front portion with the back portion of the housing 1 is done by means of snap-in connections. Nevertheless, the housing 1 is not restricted structurally.

For the instant embodiment, the first and second front shells 11*a*, 12*a* are made with thermoplastic rubber (TPR). Whereas the first and second back shells 18, 19 are made with ABS, which is a hard thermoplastic. Nevertheless, the first front shell 11*a*, the second front shell 12*a*, the first back shell 18, and the second back shell 19 can also be made with other materials which have equivalent physical properties.

In the instant embodiment, the audio-output hole 15 extends from one end of the housing 1 internally, and one end of the sound guide 62 of the speaker box 6 extends to the audio-output hole 15. The ear-abutting member 4 has a contacting portion 42. The contacting portion 42 has the same shape as the outer surface of the microphone 3. The contacting portion 42 of the ear-abutting member 4 meets the periphery of the microphone 3, to establish physical contact between the abutting member 4 and the microphone 3.

The supporting member 5 of the instant embodiment is formed integrally with the housing 1. In other words, the supporting member 5 is formed integrally with the respective end of the first and second front shells 11*a*, 12*a*. The supporting member 5 is substantially annular-shaped having the connecting hole 52 formed thereon. In other words, the supporting member 5, which is substantially annular-shaped, is formed internally of the front portion of the housing 1, after the first and the second front shells 11*a*, 12*a* have been interconnected. Whereas the connecting hole 52 is defined internally of the supporting member 5. One end of the microphone 3 is inserted into the connecting hole 52 for mounting the microphone 3 onto the supporting member 5. Thereby, the microphone 3 is able to be suspended in the receiving space 13 and better protected against vibrations. The inner surface of the supporting member 5 that defines the connecting hole 52 can further have a plurality of protrusions 521. The number of the protrusions 521 is ideally but not limited to four, where these protrusions 521 abut the outer surface of the microphone 3. Thus, the microphone 3 is better buffered against vibrations. The supporting member 5 is arranged between the housing 1 and the microphone 3. The microphone 3 is suspended in the receiving space 13 of the housing 1. In other words, a buffering space is created between the portion of the microphone 3 away from the supporting member 5 and the housing 1.

In particular, a spacing A is formed within the earphone of the instant disclosure. In other words, the microphone 3 is suspended by the supporting member 5 inside the housing 1. The outer surface of the microphone 3 is mostly spaced apart from the inner wall of the housing 1. Namely, the spacing A is formed between the microphone 3 and the housing 1. The spacing A allows the microphone 3 to be better buffered against vibrations. Thus, vibrations due to sound waves produced by the speaker 2 will not be transmitted to the microphone 3 through the housing 1. Thereby, the earphone is able to provide anti-noise effect in enhancing communication quality.

Furthermore, the speaker box 6 can be disposed in the earphone to guide the sound produced by the speaker 2 to the audio-output hole 15. Thereby, the sound produced by the speaker 2 is kept from interfering the microphone 3. The earphone is thus able to achieve anti-noise and echo-cancelling effects in providing improved communication quality.

The Fifth Embodiment

Referring to FIGS. 15-20, in the instant embodiment, the housing 1 includes a first front shell 11*a*, a second front shell 12*a*, a first back shell 18, and a second back shell 19. At least one connecting portion 111 is defined between the first and the second front shells 11*a*, 12*a*. The number of the connecting portions 111 is not restricted. The connecting portion 111 allows the first and second front shells 11*a*, 12*a* to adjoin with one another in constructing the front portion of the housing 1. Whereas the first and second back shells 18, 19 are interconnected to construct the back portion of the housing 1. The assembly of the first and the second front shells 11*a*, 12*a* (the front portion of the housing 1) and the assembly of the first and the second back shells 18, 19 (the back portion of the housing 1) are then interconnected.

A first trough 101 is recessed between the front portion and the back portion on the housing 1. In other words, the first trough 101 is formed concavely around the housing 1 between the front portion constructed by the first and second front shells 11*a*, 12*a* and the back portion constructed by the first and second back shells 18, 19. The first trough 101 allows the housing 1 to be defined by two interconnected sections. A second trough 102 can further be recessed between the first front shell 11*a* and the second front shell 12*a* on the housing 1. In other words, the first and second front shells 11*a*, 12*a* are separated from one another, except at respective portions thereof adjoined by the connecting portion 111.

In the instant embodiment, the second front shell 12*a* is further divided into a first sub-portion 121 and a second sub-portion 122. The first and the second sub-portions 121, 122 can be adjoined by screwing, snap-in connection, gluing, etc. The first and second sub-portions 121, 122 are matchingly constructed to provide easy in housing the microphone 3 and the ear-abutting member 4 therein. The audio-output hole 15 of the instant embodiment is arranged on one end of the first front shell 11*a*. In other words, the audio-output hole 15 is arranged on one end of the front portion of the housing 1. The receiving hole 16 is partially formed on an end of the first and second back shells 18, 19. In other words, the receiving hole 16 is arranged on one end of the back portion of the housing 1.

The speaker 2 of the instant embodiment is arranged in the first and the second back shells 18, 19. In other words, the speaker 2 is arranged inside the back portion of the housing 1. Namely, the main body 61 of the speaker box 6 is arranged inside the back portion of the housing 1. One end of the sound guide 62 is connected to the main body 61, while the other end thereof is extended to the front portion of the housing 1 (first front shell 11*a*) and the audio-output hole 15.

The microphone 3 of the instant embodiment is arranged in the second front shell 12*a*. In other words, the microphone 3 is arranged inside the front portion of the housing 1. The sound guide 62 of the speaker box 6 and the microphone 3 are arranged in the first front shell 11*a* and the second front shell 12*a*, respectively. Thereby, the speaker box 6 and the microphone 3 are separated from one another. One end of the microphone 3 may be supported by a suitable supporting element (not shown), such that the microphone 3 will be suspended inside the housing 1 (not shown).

For the instant embodiment, an ear-abutting portion 123 is protruded from the front portion (the second sub-portion 12*a*) of the housing 1. The ear-abutting member 4 abuts the inner surface of the ear-abutting portion 123, and the ear-abutting portion 123 can abut to the user's ear canal. The contacting portion 42 of the ear-abutting member 4 abuts the microphone 3, such that the ear-abutting member 4 may contact the microphone 3. The ear-abutting member 4, however, can also be neglected.

The front portion (the first and the second front shells 11*a*, 12*a*) of the housing 1 can further be fitted with an earbud cover 9. The earbud cover 9 is made of silicone or foam, but is not restricted thereto. The foam material allows the earbud cover 9 to snuggingly fit into the user's ear canal. The earbud cover 9 has an access hole 91 formed thereon to expose the ear-abutting portion 123. Thus, the ear-abutting portion 123 can abut the user's ear canal. The earbud cover 9 further has a via-hole 92 formed thereon aligned with the audio-output hole 15, such that the sound can be transmitted to the ear. The ear-abutting portion 123 allows the ear-abutting member 4 to abut the user's ear canal. Thereby, the ear-abutting member 4 and the microphone 3 may pick up the vibrations produced by the sound, before transmitting the received signal to the circuit unit 7.

The earphone of the instant disclosure is formed with buffering space therewithin. Namely, the first trough 101 between the front and back portions of the housing 1 provides the buffering space therebetween. The speaker 2 is arranged inside the back portion of the housing 1, and the microphone 3 is arranged inside the front portion of the housing 1. Thereby, the speaker 2 and the microphone 3 are separated from one another. The separation protects the microphone 3 against vibrations passed through the housing 1 due to sound waves produced by the speaker 2. Thus, the earphone is able to achieve anti-noise effect in providing improved communication quality.

Moreover, the front portion of the housing 1 of the instant disclosure can further be divided into the first and second front shells 11*a*, 12*a*. The second trough 102 between the first and second front shells 11*a*, 12*a* creates the buffering space therebetween. Thus, the respective path of sound wave propagation of the speaker 2 and the microphone 3 can be individually isolated. Thereby, the earphone is able to achieve anti-noise and echo-cancelling effects in providing improved communication quality.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. An earphone integrated with a microphone, comprising:

a housing having an audio-output hole formed thereon and a receiving space formed therein;

a speaker arranged in the receiving space of the housing;

a microphone being an audio-recording device and arranged in the receiving space of the housing;

a speaker box disposed in the receiving space, wherein the speaker box has a main body and a sound guide, one end of the sound guide is connected to the main body, the other end of the sound guide extends to the audio-output hole, and the speaker is arranged in the main body of the speaker box;

a supporting member arranged in the housing, wherein one end of the microphone is mounted on the supporting member for suspending the microphone in the receiving space and forming a buffering space around the microphone;

wherein when in use the microphone and the speaker box are arranged in the lower and upper portion of the receiving space respectively.

2. The earphone integrated with a microphone of claim 1, wherein the microphone is arranged toward the audio-output hole of the housing.

3. The earphone integrated with a microphone of claim 1, wherein the housing has a receiving hole formed thereon, wherein the speaker and the microphone are connected electrically to a circuit unit, wherein a button is accommodated by the receiving hole and connected electrically to the circuit unit.

4. The earphone integrated with a microphone of claim 1, further comprising an ear-abutting member in contact with the microphone, wherein the ear-abutting member has a through hole formed thereon for inserting the microphone therethrough.

5. The earphone integrated with a microphone of claim 4, wherein the ear-abutting member passes through an opening formed on the housing to protrude outside of the housing.

6. The earphone integrated with a microphone of claim 1, wherein the supporting member is fixed to the housing.

7. The earphone integrated with a microphone of claim 6, wherein a fastening portion is formed in the housing, and wherein a restricting slot is formed on the periphery of the supporting member for engaging the fastening portion.

8. The earphone integrated with a microphone of claim 1, wherein the supporting member is integrally formed with the housing.

9. The earphone integrated with a microphone of claim 1, wherein an inner surface of the supporting member defines a connecting hole for inserting one end of the microphone therein.

10. The earphone integrated with a microphone of claim 9, wherein the inner surface has a plurality of protrusions abutting to the microphone.

11. The earphone integrated with a microphone of claim 1, wherein the speaker is arranged in proximity to the audio-output hole in the receiving space of the housing.

12. An earphone integrated with a microphone, comprising:

a closed housing having a first semi housing and a second semi housing interconnected to form the hollow housing, portions of the housing defining an audio-output;

a speaker box disposed in the housing and having a main body and a sound guide, wherein the sound guide connects between the main body and the audio-output hole;

a speaker disposed within the main body of the speaker box;

an annular supporting member disposed in the housing, wherein an inner surface of the supporting member has a plurality of protrusions directed toward the centre, and a peripheral wall of the supporting member is formed with an annular restriction slot thereon; and a microphone capable of recording and sleeved by the annular supporting member;

wherein the housing has a fastening portion conformingly received by the annular restriction slot of the supporting member;

wherein the microphone is suspended in the housing and a buffering space is formed around the microphone.

* * * * *